US007555812B1

(12) United States Patent
Pinney

(10) Patent No.: US 7,555,812 B1
(45) Date of Patent: Jul. 7, 2009

(54) BRUSHLESS VACUUM CLEANER

(76) Inventor: Craig A. Pinney, 7315 Owlcrest Ct., North Highlands, CA (US) 95660

( * ) Notice: Subject to any disclaimer, the term of this patent is extended or adjusted under 35 U.S.C. 154(b) by 517 days.

(21) Appl. No.: 11/051,820

(22) Filed: Feb. 4, 2005

(51) Int. Cl.
*A47L 5/14* (2006.01)
*A47L 5/00* (2006.01)

(52) U.S. Cl. ..... 15/346; 15/345; 15/404

(58) Field of Classification Search ..... 15/345, 15/346, 404; 16/18 R, 19, 22, 27, 42 R
See application file for complete search history.

(56) References Cited

U.S. PATENT DOCUMENTS

| | | | | | |
|---|---|---|---|---|---|
| 2,064,344 | A | * | 12/1936 | Good | 15/346 |
| 2,224,202 | A | * | 12/1940 | Smellie | 15/346 |
| 2,497,435 | A | * | 2/1950 | Branneman | 15/314 |
| 2,823,412 | A | * | 2/1958 | Kirby | 15/354 |
| 2,864,119 | A | * | 12/1958 | Crise | 15/404 |
| 4,017,938 | A | * | 4/1977 | Crise | 15/346 |
| 4,207,650 | A | * | 6/1980 | Crise | 15/404 |
| 5,168,599 | A | * | 12/1992 | Williams | 15/346 |
| 5,280,667 | A | | 1/1994 | Coathupe | |
| 5,450,649 | A | | 9/1995 | Turnbull | |
| 5,562,779 | A | | 10/1996 | Allaway | |
| 5,647,092 | A | * | 7/1997 | Miwa | 15/346 |
| D392,430 | S | | 3/1998 | Piccaluga | |
| 5,970,574 | A | | 10/1999 | Thrash | |
| 6,052,861 | A | * | 4/2000 | Keller | 15/321 |
| 2001/0039691 | A1 | * | 11/2001 | Bobrosky et al. | 15/339 |
| 2002/0184730 | A1 | * | 12/2002 | Allen et al. | 15/346 |
| 2003/0126715 | A1 | * | 7/2003 | Krymsky et al. | 15/346 |
| 2003/0131440 | A1 | * | 7/2003 | Illingworth | 15/346 |

* cited by examiner

*Primary Examiner*—Bryan R Muller

(57) ABSTRACT

The brushless vacuum cleaner is an electrical cleaning device that would feature conventional components from traditional upright vacuum cleaners but would use forced air to agitate debris from the surface to be cleaned. The brushless vacuum cleaner would consist of a base unit with multiple air injectors on the bottom, a pump case located on top of the base unit, a collection unit extending upward from the pump case, a vacuum chamber connecting the bottom of the base unit to the collection unit, and a handle that features various control buttons. The pump case would contain an electrical motor which would operate a dual-cycle agitator responsible for pulsing air flow through alternating air injectors on every other cycle. This system would replace the beater brush found on conventional upright vacuum cleaners, thus creating less wear and tear to carpeting and prolonging the life of the carpet.

8 Claims, 5 Drawing Sheets

BRUSHLESS VACUUM CLEANER

BACKGROUND OF THE INVENTION

1. Field of the Invention

The present invention relates to a cleaning apparatus for use in connection with vacuuming carpets and other flooring. The brushless vacuum cleaner has particular utility in connection with cleaning a carpet with pulsed air flow for agitation, thereby reducing the wear on a carpet caused by beater brushes in conventional vacuums.

2. Description of the Prior Art

Conventional vacuum cleaners make use of vacuum pressure to draw air and debris adjacent to the vacuum cleaner head into a collection device. Many different forms of vacuum cleaner heads have been developed in the past to aid the debris collection effort. Beater brushes or bars are typical examples of these cleaner heads. A beater brush is used to agitate an area of the surface to be cleaned in an attempt to loosen debris that might not otherwise be susceptible to being lifted by the suction force of the vacuum cleaner. However, beater brushes inflict wear on surfaces over time and can cause premature replacement of floor coverings such as carpet. The brushes themselves also suffer wear and require eventual replacement to perform at an acceptable level. Therefore, a vacuum cleaner that employed a method other than beater brushes for loosening debris would be of interest to any household or business employing a vacuum for cleaning floor surfaces.

The use of brushless vacuum cleaners is known in the prior art. For example, U.S. Pat. No. 6,052,861 to Kris D. Keller discloses a vacuum system in which hot air is discharged from the vacuum cleaner, moves across the surface being cleaned, and is subsequently drawn back upwardly through the intake plenum. A fluid discharge line is positioned within the intake plenum and includes fluid discharge openings oriented to direct pumped fluid downwardly and angularly toward the bottom end of the hot air discharge plenum to impinge upon the surface being cleaned and to be subsequently drawn into the intake plenum. However, the Keller '861 device uses a fluid for cleaning purposes which would not be suitable for frequent use in cleaning carpets or other fiber based flooring materials. Additionally, the heat discharged by the Keller '861 vacuum system would cause premature wear on carpets and other flooring materials.

U.S. Pat. No. 5,562,779 to Allan W. Allaway, Ian Blair, and Allan J. Seefeld discloses a device and method for cleaning particulate material that is used for renovating synthetic grass playing surfaces which optionally include a layer of particulate material, such as sand. The device consists of a plenum chamber which directs a fast moving jet of air against the particulate to dislodge it from the surface and direct it into a manifold. The manifold partially surrounds the plenum chamber and is designed to separate out the fine particles, directing them to a collection area, while laying the coarse particulate back on the surface. However, the Allaway, et al. '861 device returns some of the particulate matter to the surface being cleaned; therefore, it would not be useful for cleaning of residential or commercial flooring. Furthermore, the Allaway, et al. '861 device contains a filtering mechanism which would increase the complexity and, thus, the cost of the device over other vacuum type floor cleaners.

Similarly, U.S. Pat. No. 5,450,649 to Kenneth J. Turnbull discloses a collection device having a duct for transporting material entrained in a stream of pressurized primary air from a collection mouth at an upstream end of the duct to a downstream region of the duct for collection. The device has a primary air outlet appropriately directed to entrain dirt on the surface to be cleaned into the air collection stream and a secondary air outlet which can be used to blow debris into a pile for subsequent collection. However, the Turnbull '649 device would be difficult for use in cleaning corner areas of the room since the secondary air outlet would direct pressurized air away from the apparatus, thus scattering debris away from the air collection stream. Furthermore, the plenum and duct formation is a rigid construction that does not allow the user to vertically adjust the unit for ease of use or storage purposes. Finally, the Keller '861 system allows only a single direction for the air stream generated by the unit, which might not loosen as much debris from the surface to be cleaned as air streams originating from multiple directions.

U.S. Pat. No. 5,970,574 to Thomas B. Thrash, Jr. discloses an apparatus and method for cleaning hard surfaces by removing and containing waste. The Thrash apparatus produces a high velocity airflow to dislodge debris from the surface and high velocity streams of cleaning fluid for cleaning the surface. However, the Thrash, Jr. '574 apparatus is intended for use on hard surfaces and not on carpeted surfaces. Moreover, frequent use of the Thrash, Jr. '574 device on carpeted surfaces could cause premature wear on the carpet.

Likewise, U.S. Pat. No. 5,280,667 to John E. Coathupe discloses a collection device that comprises a pair of air outlet pipes surrounding an air inlet duct, all of which are connected to a collection head. Air is forced down the pipes via a motor and fan arrangement to dislodge debris from the surface to be cleaned. The end of each pipe is curved toward the air inlet duct, aiding the entrainment of debris into the air stream flowing into the air inlet duct. However, the Coathupe '667 device would be difficult to move across a surface since it does not provide wheels or another arrangement on the bottom of the device for ease of movement. In addition, the placement of the filter bag on the Coathupe '667 device might allow microscopic particles to escape into the air that is breathed by the user. This could cause difficulty in breathing, especially for individuals with asthma or allergies.

Lastly, U.S. Pat. No. Des. 392,430 to Francesco Piccaluga and Aldo Piccaluga discloses the ornamental design for an upright vacuum cleaner. However, the Piccaluga, et al. '430 device employs a beater brush which could cause premature wear and damage to the floor cover being cleaned. Additionally, the Piccaluga, et al. '430 patent makes no indication that the device would be capable of cleaning corners through the use of angled air streams or special suction units located in the front corners of the device.

While the above-described devices fulfill their respective, particular objectives and requirements, the aforementioned patents do not describe a floor cleaning device that uses air agitation in multiple directions to loosen debris for collection via an intake plenum in the device, thus allowing the user to effectively clean not only the flat surface but also the corners of a room. The Keller '861 and Thrash, Jr. '574 devices use a fluid for cleaning purposes and would not be suitable for frequent use in cleaning carpets or other fiber based flooring materials. Moreover, frequent use of either the Thrash, Jr. '574 or Keller '861 device on carpeted surfaces could cause premature wear of the carpet due to the high velocity fluid streams used by the Thrash, Jr. '574 device and the heat and fluid discharged by the Keller '861 device. The Piccaluga, et al. '430 device could also cause premature wear of the floor covering due to the use of a beater brush for disloding debris. Additionally, the Allaway, et al. '861 device returns some of the particulate matter to the surface being cleaned; therefore, it would not be useful for cleaning of residential or commercial flooring. The Turnbull '649 and Piccaluga, et al. '430 devices would not be advantageous for cleaning the corners of a room. The secondary air outlet of the Turnbull '649 device directs pressurized air away from the apparatus, thus scattering debris away from the air collection stream, while the Piccaluga, et al. '430 patent fails to address the issue. Furthermore, the Turnbull '649 device allows only a single direction for the air stream generated by the unit, which would not loosen as much debris from the surface to be cleaned as air streams originating from multiple directions. The rigid construction of the plenum and duct of the Turnbull '649 device does not allow the user to vertically adjust the unit for ease of use or storage purposes. The Coathupe '667 device would be difficult to move since no wheels are provided on the bottom of the device. Additionally, the placement of the filter bag on the Coathupe '667 device might allow microscopic particles to escape into the air that is breathed by the user. Finally, the Allaway, et al. '861 device contains a filtering mechanism which would increase the complexity and, thus, the cost of the device over other vacuum type floor cleaners.

Therefore, a need exists for a new and improved brushless vacuum cleaner that can be used for easily and effectively cleaning corners and flooring surfaces while decreasing the amount of wear and tear on the floor covering that might be caused by a conventional vacuum cleaner with a beater brush. In this regard, the present invention substantially fulfills this need. In this respect, the brushless vacuum cleaner according to the present invention substantially departs from the conventional concepts and designs of the prior art, and in doing so provides an apparatus primarily developed for the purpose of cleaning a carpet with pulsed air flow for agitation, thereby reducing the wear on a carpet caused by beater brushes in conventional vacuums.

SUMMARY OF THE INVENTION

In view of the foregoing disadvantages inherent in the known types of vacuum cleaners now present in the prior art, the present invention provides an improved brushless vacuum cleaner, and overcomes the above-mentioned disadvantages and drawbacks of the prior art. As such, the general purpose of the present invention, which will be described subsequently in greater detail, is to provide a new and improved brushless vacuum cleaner which has all the advantages of the prior art mentioned heretofore and many novel features that result in a brushless vacuum cleaner which is not anticipated, rendered obvious, suggested, or even implied by the prior art, either alone or in any combination thereof.

To attain this, the present invention essentially comprises a base unit with multiple air injectors on the bottom, a pump case located on top of the base unit, a collection unit extending upward from the pump case, a vacuum chamber connecting the bottom of the base unit to the collection unit, and a handle that features various control buttons. The pump case would contain an electrical motor and a dual-cycle agitator responsible for pulsing air flow through alternating air injectors on every other cycle and creating a vacuum suction for movement of debris into the vacuum chamber and subsequently into the collection chamber.

There has thus been outlined, rather broadly, the more important features of the invention in order that the detailed description thereof that follows may be better understood and in order that the present contribution to the art may be better appreciated.

The invention may also include air injectors placed at the front corner of the base unit and angled inward and downward for ease in cleaning corner areas, as well as a horizontal extension from the side of the base unit to create a wider cleaning path for the vacuum. There are, of course, additional features of the invention that will be described hereinafter and which will form the subject matter of the claims attached.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. In this respect, before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved brushless vacuum cleaner that has all of the advantages of the prior art vacuum cleaners and none of the disadvantages.

It is another object of the present invention to provide a new and improved brushless vacuum cleaner that may be easily and efficiently manufactured and marketed.

An even further object of the present invention is to provide a new and improved brushless vacuum cleaner that has a low cost of manufacture with regard to both materials and labor, and which accordingly is then susceptible of low prices of sale to the consuming public, thereby making such a brushless vacuum cleaner economically available to the buying public.

Still another object of the present invention is to provide a new brushless vacuum cleaner that provides in the apparatuses and methods of the prior art some of the advantages thereof, while simultaneously overcoming some of the disadvantages normally associated therewith.

Even still another object of the present invention is to provide a brushless vacuum cleaner that uses pulsed air flow to agitate the dirt and debris from the surface to be cleaned. This reduces the wear and tear on floor coverings, such as carpet, that is caused by conventional beater brushes, thereby extending the life of the carpet and saving the cost of replacing prematurely worn carpet.

Yet another object of the present invention is to provide a brushless vacuum cleaner that provides air injectors at the front left corner that are angled inward and downward. This allows the user to more easily clean corner areas of a room with the same vacuuming motion used in the rest of the room, saving the user a considerable amount of time and effort.

Still yet another object of the present invention is to provide a brushless vacuum cleaner that agitates debris with a pulsed air flow as opposed to a beater brush. This prevents premature wear to the vacuum cleaner, saving the user the time and expense of repeatedly replacing the beater brush for efficient cleaning.

Lastly, it is an object of the present invention to provide a new and improved brushless vacuum cleaner that provides an extension of air injectors on the side of the base unit. This allows the user to clean a wider swath with each vacuuming motion and provides a narrow extension that can be used in tight areas, significantly reducing the amount of time and effort the user must expend during cleaning.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various figures.

DESCRIPTION OF THE PREFERRED EMBODIMENT

Figure 1:
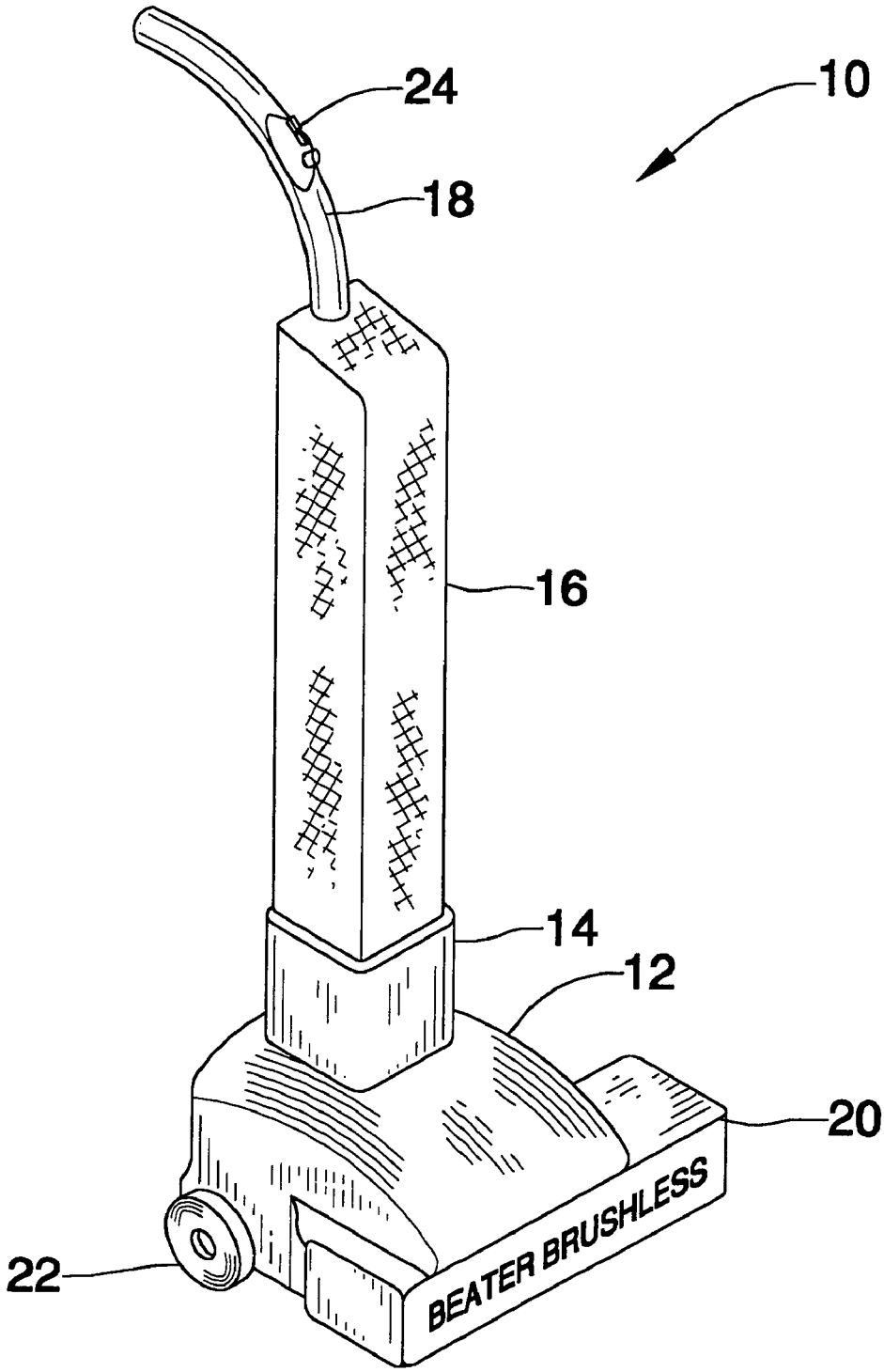
FIG. 1 is a left perspective view of the preferred embodiment of the brushless vacuum cleaner constructed in accordance with the principles of the present invention.

Referring now to the drawings, and particularly to FIGS. 1-5, a preferred embodiment of the brushless vacuum cleaner of the present invention is shown and generally designated by the reference numeral 10.

In FIG. 1, a new and improved brushless vacuum cleaner 10 of the present invention for cleaning a carpet with pulsed air flow for agitation, thereby reducing the wear on a carpet caused by beater brushes in conventional vacuums, is illustrated and will be described. More particularly, the brushless vacuum cleaner 10 would feature conventional components used to produce traditional upright vacuum cleaners; however, this appliance would use air pulsation created by an electric air pump to agitate the dirt and debris from carpeting and other flooring surfaces. The brushless vacuum cleaner 10 has a base unit 12 upon which is mounted an air pump case 14. A collection unit 16 with an attached handle 18 extends upward from the air pump case 14. The base unit 12 features a rectangular extension 20 that provides a wider cleaning swath, allowing the user to more quickly clean a room than when using a vacuum cleaner having a conventional width. The collection unit 16 could feature a bag for debris collection, or it could be a "bagless" debris collection unit. Also featured towards the rear of the base unit 12 is a pair of fixed rear wheels 22 for easy movement of the vacuum cleaner 10. The handle 18 features multiple controls, one of which is an ON/OFF activation switch 24. Other controls could be used to reduce the angle at which the collection unit 16 departs from the base unit 12 for easier control of device during the vacuuming process. Since this type of feature is available on conventional vacuum cleaners, it is understood that it exists in the prior art and is not considered a unique part of the current invention.

Figure 2:
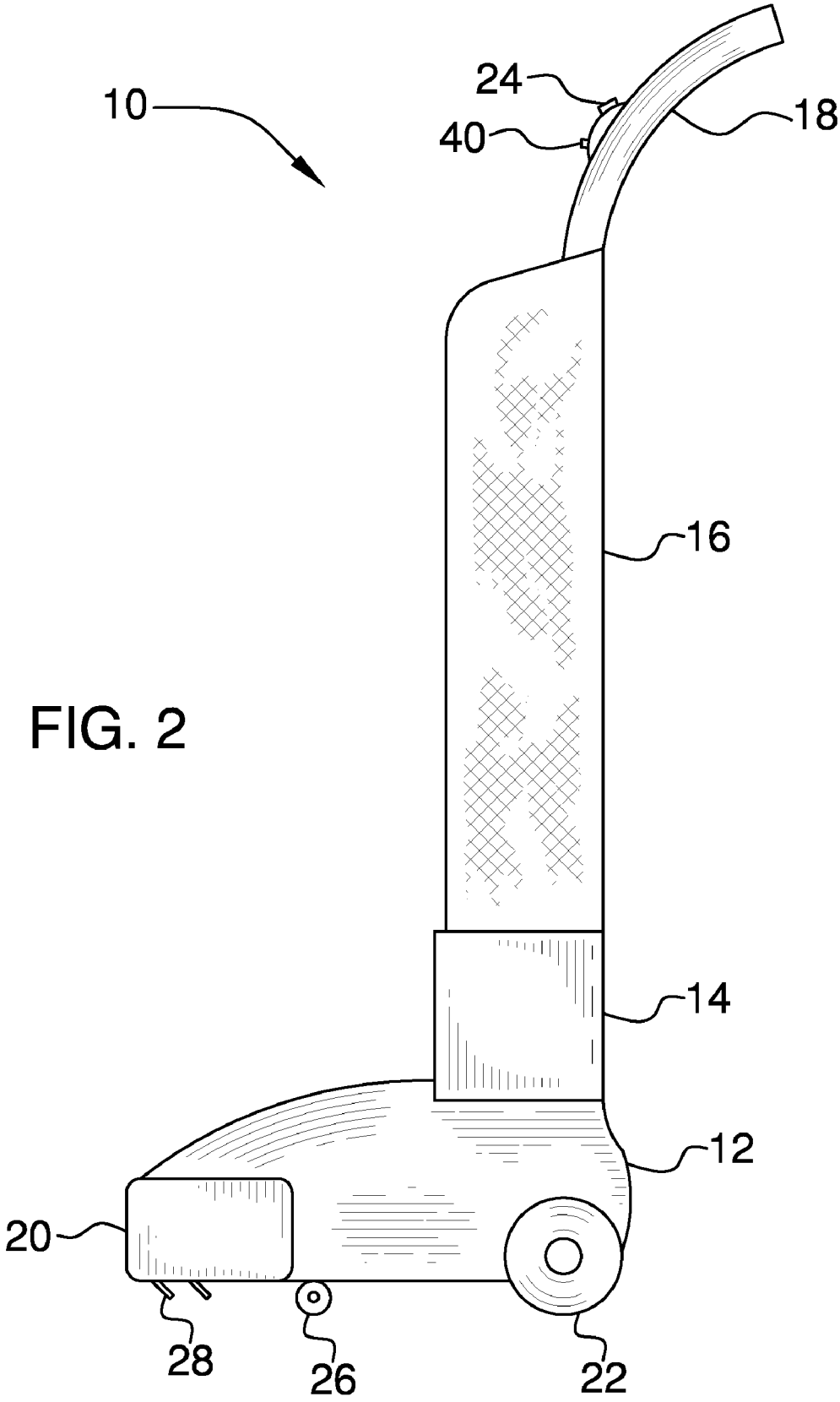
FIG. 2 is a right side view of the brushless vacuum cleaner of the present invention.
Figure 3:
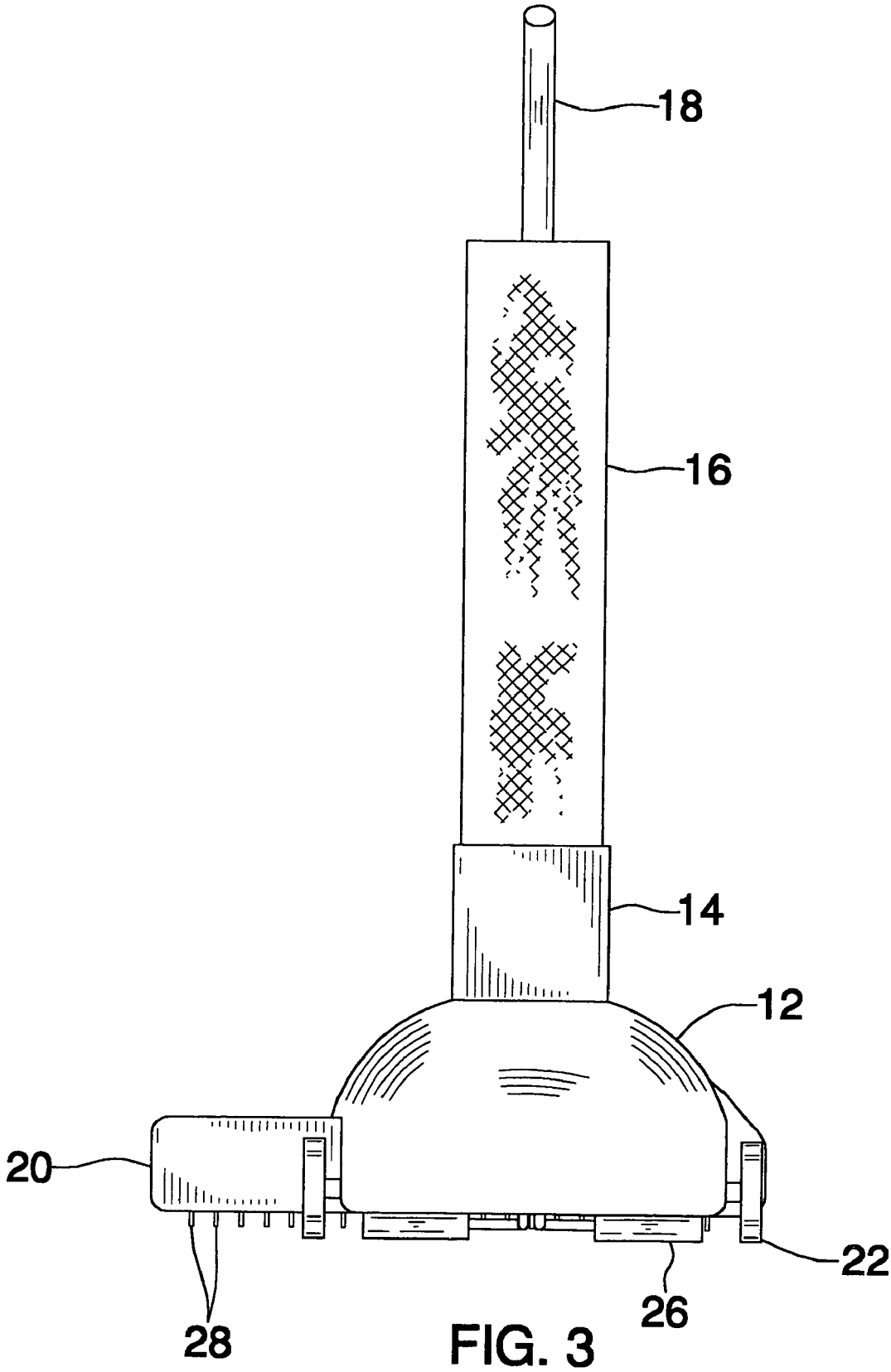
FIG. 3 is a rear view of the brushless vacuum cleaner of the present invention.

FIGS. 2 and 3 are a right side and rear view, respectively, of the brushless vacuum cleaner 10. From this view it is possible to see one of the horizontally adjustable castors 26 on the bottom of the vacuum cleaner 10 (for a more detailed view, see FIG. 4). Also visible are several of the air injectors 28 which channel air flow to loosen debris on the surface for removal via the suction of the vacuum cleaner 10. In addition to the ON/OFF activation switch 24, the handle 18 features a trigger buttons 40 which could be used to control the pulsed air flow used for agitation.

Figure 4:
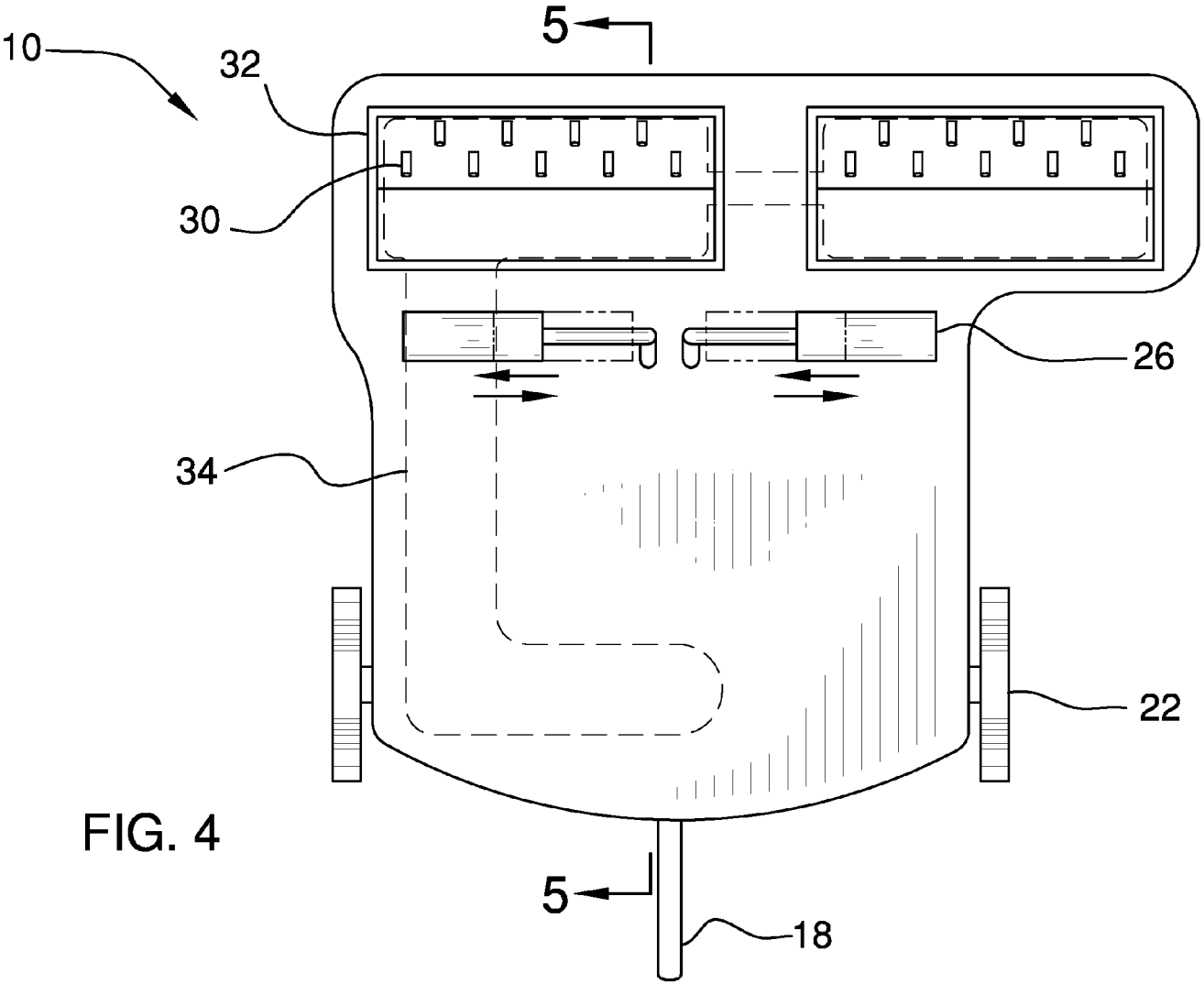
FIG. 4 is a bottom view of the brushless vacuum cleaner of the present invention.

FIG. 4 is a bottom view of the brushless vacuum cleaner 10. From this view, it can be seen that multiple inclined air injectors 30 are located in the upper left corner 32. These injectors 30 are inclined at a 45 degree angle to aid in cleaning corner areas. The horizontal range of the adjustable castors 26 is indicated by the arrows. The castors 26 provide easier maneuverability of the vacuum cleaner 10. The vacuum chamber 34, as indicated by the dotted line, is the opening through which debris would be pulled into the unit 10 through suction created within the pump case 14 of the vacuum cleaner 10.

Figure 5:
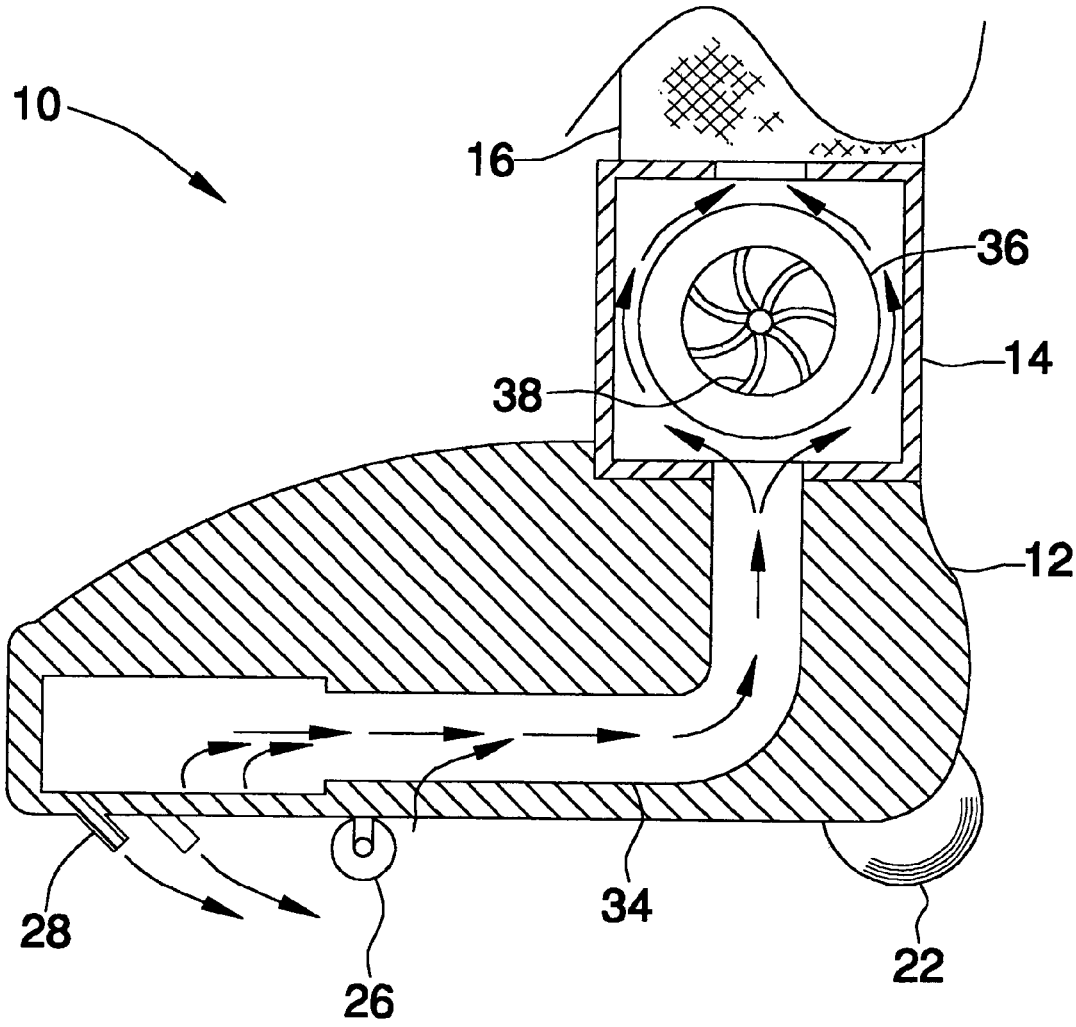
FIG. 5 is a cross sectional view of the bottom portion of the brushless vacuum cleaner of the present invention taken from the right side.

FIG. 5 is a cross sectional view of the base unit 12 and air pump case 14 taken from the right side. The pump case 14 houses the vacuum motor 36 and the vacuum agitator 38 which are configured to create pulsed air flow for discharge through the air injectors 30 and an intake air flow directing debris from the floor through the vacuum chamber 34 for subsequent accumulation in the collection unit 16, as indicated by the arrows. The vacuum motor 36 drives the vacuum agitator 38, which creates forced air for expulsion from half of the air injectors 28 on the initial agitation stroke and from the second half of the air injectors 28 on the resultant stroke. The air injectors 28 are arranged such that alternating injectors 28 are active on each stroke of the vacuum agitator 38. It is understood that the brushless vacuum cleaner 10 would typically have a conventional power cord for insertion into a standard wall outlet, although this should not rule out the use of other power sources. The power cord is not shown as it is understood to exist in the prior art and is not claimed as a unique part of the current invention.

In use, it can now be understood that the user would plug the power cord into a wall socket and activate the vacuum by turning the ON/OFF switch 24 to the ON position. The user would then roll the vacuum in a back and forth motion over the floor surface to clean debris from the floor. The castors 26 could be horizontally adjusted for increased maneuverability, and the collection unit could be angularly adjusted for easier control of the vacuum 10. The user could move the vacuum 10 into corners, where the inclined air injectors 30 force the debris from the corners back towards the vacuum chamber 34. When the cleaning job was complete, the user would turn the switch 24 to the OFF position, unplug the cord, check the collection unit 16 and empty any debris as necessary, and roll the vacuum cleaner 10 to the storage location.

While a preferred embodiment of the brushless vacuum cleaner has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. For example, any suitable sturdy material such as metal, plastic, or a variety of wood may be used instead for the base unit described. Also, the collection unit could be a plastic, wood, or metal container if a "bagless" convention is used, or it could be a durable, yet flexible, outer case with an inner disposable bag. The outer case could be made of vinyl, plastic, cotton, burlap, or a similar material, while the inner bag could be made of heavy duty paper or some other material that does not easily tear.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A brushless vacuum cleaner comprising:

a base unit having a front, a rear, a right side, a left side, a top, and a bottom forming a front right corner, a front left corner, a rear right corner, and a rear left corner and formed with a vacuum chamber extending from said bottom to said top;

a pair of wheels connected to said rear of said base unit wherein one of said pair of wheels is connected to said rear right corner of said base unit and said other of said pair of wheels is connected to said rear left corner of said base unit;

a plurality of air injectors connected to said base unit, wherein said air injectors are arranged in a plurality of rows and spaced from one another within each row;

a pump case connected to said base unit;

a vacuum agitation unit connected to said pump case;

a vacuum motor connected to said pump case;

a collection unit connected to said pump case;

a handle connected to said collection unit;

a plurality of control switches connected to said handle; and a pair of horizontally adjustable casters connected to said bottom surface of said base unit wherein said casters adjust horizontally by sliding on their axles in an axial direction of said casters.

2. A brushless vacuum cleaner comprising:

a base unit having a front, a rear, a right side, a left side, a top, and a bottom forming a front right corner, a front left corner, a rear right corner, and a rear left corner and formed with a vacuum chamber extending from said bottom to said top;

a rectangular extension connected to said front right side of said base unit;

a pair of wheels connected to said rear of said base unit wherein one of said pair of wheels is connected to said rear right corner of said base unit and said other of said pair of wheels is connected to said rear left corner of said base unit;

a pair of horizontally adjustable casters connected to said bottom surface of said base unit wherein said casters adjust horizontally by sliding their axles in an axial direction of said casters;

a plurality of air injectors connected to said base unit and to said extension, wherein said air injectors are arranged in a plurality of rows and spaced from one another within each row;

a pump case connected to said top surface of said base unit wherein said pump case is in fluid connection with the portion of said vacuum chamber extending to said top of said base unit;

a vacuum agitation unit connected to said pump case;

a vacuum motor connected to said pump case;

a collection unit connected to said pump case;

a handle connected to said collection unit; and a plurality of control switches connected to said handle.

3. The brushless vacuum cleaner of claim 2 wherein said air injectors in each row are evenly spaced along said bottom front of said base unit.

4. The brushless vacuum cleaner of claims 3 wherein most of said plurality of air injectors are angled downward and rearward from said front of said base unit.

5. The brushless vacuum cleaner of claim 3 wherein one of said plurality of control switches is an activation switch having an ON state in which said vacuum cleaner is activated and an OFF state in which said vacuum cleaner is deactivated.

6. The brushless vacuum cleaner of claim 3 wherein suction is created in said vacuum chamber by the rotation of said vacuum agitation unit by said vacuum motor to pick up debris from the floor during operation.

7. The brushless vacuum cleaner of claim 6 wherein debris sucked into said vacuum chamber is passed through said pump case into said collection unit.

8. The brushless vacuum cleaner of claim 3 wherein said pump case houses said vacuum agitation unit and said vacuum motor.

* * * * *